US005226594A

United States Patent [19]

Swenson

[11] Patent Number: 5,226,594

[45] Date of Patent: Jul. 13, 1993

[54] HOT WATER STORAGE TANK HEAT EXCHANGER SYSTEM

[75] Inventor: Paul F. Swenson, Shaker Hts., Ohio

[73] Assignee: Consolidated Natural Gas Service Company, Inc., Pittsburgh, Pa.

[21] Appl. No.: 860,051

[22] Filed: Mar. 30, 1992

[51] Int. Cl.[5] ..... G05D 23/00

[52] U.S. Cl. ..... 237/2 B; 237/12.1; 237/19; 126/362

[58] Field of Search ..... 237/12.1, 12.3 A, 12.3 B, 237/13, 59, 56, 8 R, 81, 2 B; 126/362

[56] References Cited

U.S. PATENT DOCUMENTS 4,976,464 12/1990 Swenson ..... 237/81
5,029,442 7/1991 Nishiyama ..... 237/12.1 X
5,098,036 3/1992 Brigham et al. ..... 237/12.1 X

*Primary Examiner*—Henry A. Bennett
*Attorney, Agent, or Firm*—Pearne, Gordon, McCoy & Granger

[57] ABSTRACT

A heat storage system for a fuel fired prime mover driven space conditioner. Rejected heat from the prime mover is advantageously stored in a storage type potable hot water heater. Heat is transferred from a coolant fluid for the prime mover by forcibly circulating water from the tank of the potable hot water heater with a pump driven by the hydraulic energy of the coolant fluid. Since the coolant fluid flows when the prime mover is operated, control circuitry for the water circulating pump is avoided.

5 Claims, 1 Drawing Sheet

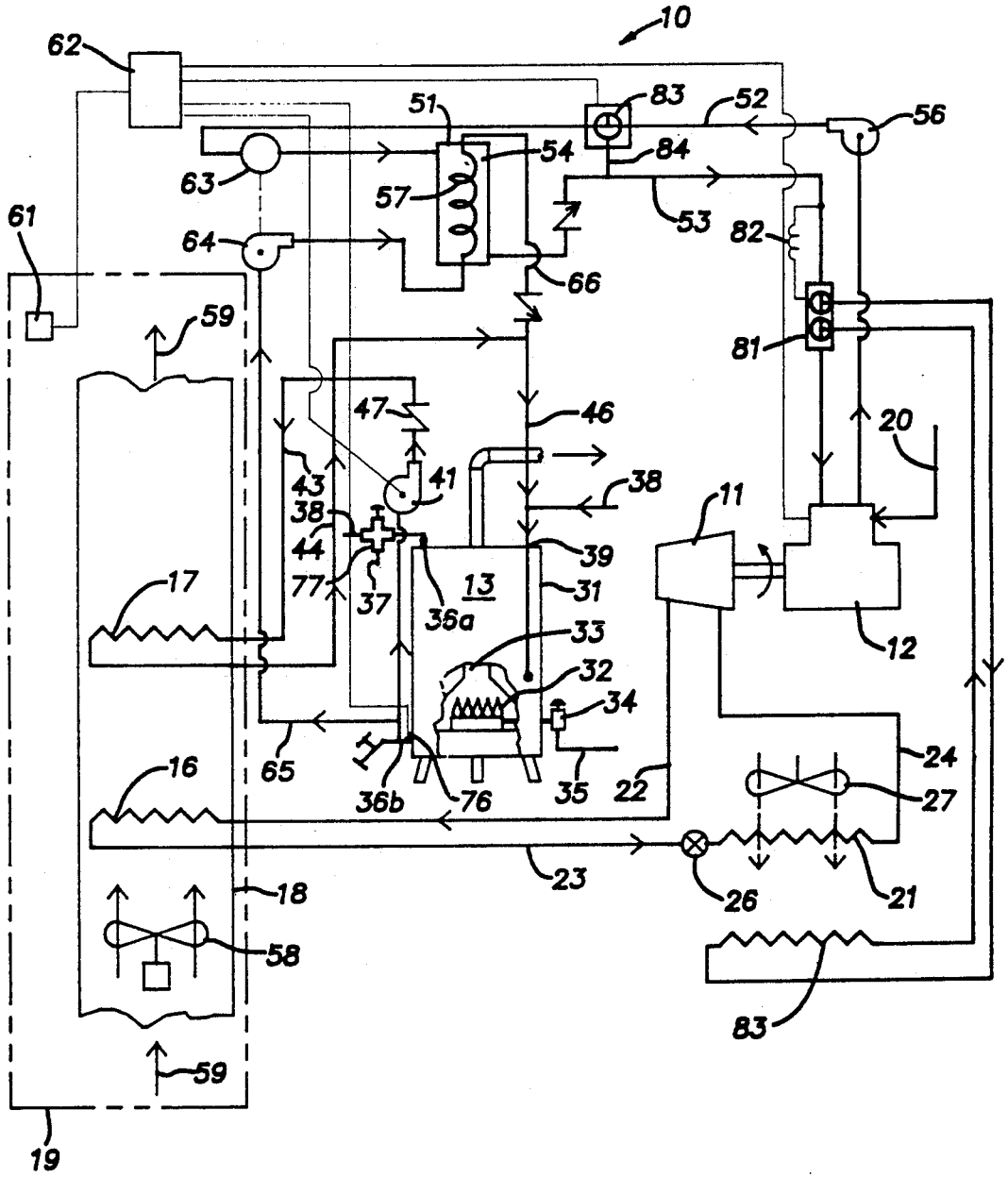
10
62
51
83
52
56
54
84
63
57
53
61
64
82
66
59
81
47
46
20
43
41
38
38
11
44
39
77
37
13
31
36a
17
33
12
32
34
65
24
16
36b
76
35
22
27
23
26
21
18
58
83
59
19

HOT WATER STORAGE TANK HEAT EXCHANGER SYSTEM

BACKGROUND OF THE INVENTION

The invention relates to improvements in heat energy systems and, in particular, to a simplified system for transferring heat to a storage tank from a source remote from the tank.

PRIOR ART

U.S. Pat. No. 4,976,464 describes a fuel-fired heat pump system particularly suited to the space heating and cooling needs of a residence or like building and which advantageously utilizes a conventional storage-type hot water tank. The system disclosed in the patent reduces cycling losses associated with the heat pump unit by storing heat energy in the water tank and using such energy at appropriate times to reduce the number of cycles that the heat pump is caused to operate. The patent teaches the economy of using such a hot water storage tank that is the result of the commodity-like nature of such units achieved through their mass production, marketing and sales distribution.

SUMMARY OF THE INVENTION

The invention provides a simplified fluid circuit for transferring heat to a storage tank from a heat source that supplies heat on an intermittent and/or cyclic basis. In the broader aspects of the invention, the condition of a first fluid associated with the heat source is sensed and when this condition is indicative of available heat, a pump is automatically operated to circulate a second fluid from the heat storage tank. The first fluid is caused to circulate and to transfer heat to the second fluid at respective heat transfer zones in their circulating paths.

In the disclosed embodiment, a first fluid associated with a heat source is circulated through a path that includes a heat transfer zone and a hydraulic motor that is operated by the hydraulic energy of the first fluid. The hydraulic motor, in turn, operates a pump to circulate a second fluid from the heat storage tank through a path external of the tank that includes a heat transfer zone in thermal communication with the heat transfer zone of the first fluid. Heat passes from the first fluid to the second fluid at their respective heat transfer zones. Since the hydraulic energy of the first fluid is used to circulate the second fluid no electrical controls or electrical power circuit is required to produce flow of the second fluid.

In the disclosed embodiment, the invention takes the form of a space conditioning system similar to that in the aforementioned U.S. Pat. No. 4,976,464. A fuel-fired prime mover, such as an internal combustion engine, has its rejected heat absorbed by a coolant or first fluid that is circulated through a path that includes a heat rejection transfer zone. Hydraulic energy of the coolant fluid energizes a motor and pump set that causes potable water, the second fluid, to circulate from a hot water storage tank through a path that includes a heat transfer zone and then back to the tank. Heat is efficiently exchanged from the coolant to the water fluids since the coolant only circulates when the prime mover operates. Control circuitry for the potable water heat transfer loop is unnecessary.

BRIEF DESCRIPTION OF THE DRAWING

The FIGURE is a schematic representation of a space conditioning system embodying the invention.

DESCRIPTION OF THE PREFERRED EMBODIMENT

The system disclosed herein is similar to that disclosed in the aforementioned U.S. Pat. No. 4,976,464 and reference can be made thereto for additional details. In general, the same or similar parts are designated herein with the same numerals as are found in the patent.

The FIGURE illustrates a heating system 10 suitable for space heating a residential area such as a house, apartment, office or like space. The system 10 includes a heat pump compressor 11 driven by a prime mover 12 and a storage-type potable hot water heater 13. The system 10 further includes heat exchanger coils 16 and 17 in a duct 18 through which air from the space being heated is circulated. The closed space being heated or conditioned by the system 10 is schematically illustrated by the broken line 19. The present disclosure involves heating service but it will be appreciated by those familiar with the art that suitable valves and control elements, known in the art, can be provided for operating the heat pump to cool the space 19 being conditioned. For example, U.S. Reissue Pat. No. 31,281, illustrates suitable valving for reversing the heat pump heat exchangers.

The prime mover 12 preferably is an internal combustion engine or other heat engine such as a Stirling, steam or gas turbine driven unit and is preferably fueled by natural gas or other combustible fuel supplied by a line 20. Hereinbelow, the prime mover 12 is generally referred to as the engine; its rejected heat is available on an intermittent or cyclical basis. The illustrated heat pump compressor 11 is preferably a refrigerant vapor compressor producing a reverse Rankine vapor compression cycle. It will be understood that various types of compressors such as reciprocating, screw, vane or centrifugal can be used. Further, a reverse Brayton heat pump cycle can also be used.

In heating service, a refrigerant fluid, when the heat pump compressor 11 is operating, circulates through the heat exchanger 16 located in the air duct 18 and through another coil or heat exchanger 21 21 located outdoors and interconnecting lines 22–24. Heat is absorbed by the refrigerant fluid at the outdoor heat exchanger 21 and is exchanged from this fluid to air at the indoor heat exchanger 16. A refrigerant liquid expansion valve 26 in the line 23 causes the refrigerant to enter the outdoor heat exchanger partially vaporized at low pressure and low temperature. The outdoor coil 21 is in heat exchange relation to outdoor air which may be circulated across the coil by a powered fan 27. Alternatively, the outdoor coil 21 may be in heat exchange relation with sub-surface media such as ground water or with a solar pond. Heat absorbed by the refrigerant as it passes through the coil 21 causes it to be vaporized. The compressor elevates the pressure of the vaporized refrigerant and, therefore, the condensing temperature of the refrigerant fluid before it enters the heat exchanger 16. The refrigerant condenses in the heat exchanger 16 giving up heat.

Relatively high temperature heat storage is preferably provided by the unit 13 in the form of a conventional commercially available storage-type potable hot water heater. Particularly suited for this application are appliances which comply to American National Standards Institute standard Z-21.10.

The water heater 13 includes a tank 31 with a capacity in the range of 30-50 gallons, for example, and a burner 32 with a capacity in the range of 36,000 to 100,000 btu/hr., for example, centrally located at the bottom of the tank 31. The burner 32 mixes natural gas from a supply line 35 and air and supports combustion of the same. Combustion products from the burner 32 pass through a vertical stack 33 through the center of the tank 31 to heat potable water stored therein in a known manner.

A conventional thermostatic control valve 34 responds to the temperature of water in the tank 31 and operates the burner 32 whenever the temperature falls below a predetermined limit, for example, 120° F. An outlet 36*a* on the heater tank 31 supplies potable hot water through a line 37 to sink taps and the like at the space 19. A source of cold potable water, such as a public utility line, supplies an inlet 39 of the tank 31 through a cold water line 38 to make up for water use at the taps. A conventional thermostatic blending or tempering valve 77, between the tank outlet 36*a* and the line 37, is preferably of the manually adjustable type and limits the temperature of potable water delivered to the taps and the like to a temperature of about 120° F. When the temperature of potable water in the tank 31 is above 120° F., the valve 77 mixes potable cold water from the line 38 with potable hot water from the tank to maintain the predetermined desired delivery temperature.

A pump 41 operates to circulate potable hot water stored in the tank 31 through the heat exchanger 17 in the air duct 18. The pump 41 with its inlet connected to the tank drain outlet 36*b* circulates the hot water through line 43 to the heat exchanger 17, a line 44 from the heat exchanger and then through a line 46 to the tank inlet 39. A check valve 47 prevents thermo siphon induced flow during periods when the pump 41 is not operating.

A liquid-to-liquid heat exchanger 51 is arranged to transfer heat rejected by the engine 12 to potable water stored in the tank 31. The heat exchanger 51 eliminates mixing of engine coolant (liquid) with the potable water (liquid) stored in the tank 31 for health reasons. In the illustrated case, engine coolant circulates in a path through lines 52 and 53 to and from a shell 54 of the heat exchanger 51. If desired, this engine coolant can be arranged to receive heat from the engine exhaust of combustion products in an exhaust gas heat exchanger in a known manner. A pump 56 represents a conventional engine coolant or "water" pump mechanically driven by the power shaft of the engine 12. The pump 56 operates whenever the engine 12 runs to circulate engine coolant through the shell 54. In a known manner, flow of coolant through the engine can be delayed on engine start-up or otherwise modulated by a conventional thermostat associated with the engine 12. A coil 57 of the exchanger 51 is connected across the outlet 36*b* and inlet 39 of the tank 31 through lines 65 and 66.

In accordance with an important aspect of the invention, the engine coolant fluid, typically a suitable liquid such as a solution of water and conventional antifreeze such as ethylene glycol or other conventional antifreeze liquid, is caused to pass through a hydraulic or fluid motor 63 connected in series in the line 52 to the heat exchanger shell 54. The engine coolant flow hydraulically operates the motor 63 so that, in effect, the motor senses the condition of flow of the engine coolant. The motor 63 drives a pump 64 that is disposed in series in the line 65 from the tank drain outlet 36*b* to the heat exchanger coil 57. The motor 63 and pump 64 are manufactured as a unit with their respective fluid working chambers sealed from one another. For example, when their working elements are a rotary turbine and impeller, their respective fluid working chambers are sealed from one another and their respective shafts are coupled magnetically in a manner known in the motor/pump art. It is important to ensure with the design of the motor pump unit that there can be no leakage of coolant into the circulating water circuit so as to prevent a health hazard.

It will be understood that the shell 54 forms a heat transfer zone for the engine coolant or fluid circulating path from the engine 12 through the line 52 and back to the engine through the line 53. Similarly, the coil 57 forms a heat transfer zone for the potable water circulating path from the storage tank 31 through the line 65 and back to the tank through the line 66. Heat rejected by the engine 12 and absorbed by the engine coolant is transferred at these zones in the exchanger 51 to the potable water being circulated therein from and to the storage tank 31. As a result, the heat rejected by the engine 12 is transferred to the potable water stored in the tank 31.

Generally, the engine coolant pump 56 operates when the engine 12 operates. As a result, potable water is automatically circulated from the tank 31 to the exchanger 51 and back to the tank by operation of the motor pump unit 63, 64 in direct response to flow of coolant through the lines 52, 53. Circulation of the potable water is thus coincident with operation of the engine or prime mover 12. Generally, when the engine 12 stops, the pump 56 stops and, in turn, the motor/pump 52, 53 stops. It can be seen that no control valves or electrical control elements are necessary to start, maintain or stop the circulation of potable water from the tank 31 to the heat exchanger 51. Heat loss to the environment from the potable water in the tank is reduced during periods that the engine does not run because circulation of potable water from the tank through the lines 65, 66 at such times is avoided.

Rejected heat from the engine 12 is available at a higher temperature than the temperatures reached by the heat pump refrigerant so that the heat exchanger 17 associated with the rejected heat and with the tank 31 is downstream of the heat pump heat exchanger 16 in the duct 18. A blower 58 circulates air from the space 19 being conditioned through the duct 18 in the direction indicated by the arrows 59 in order to heat this air at the exchangers 16, 17. The engine 12 and heat pump compressor 11 are ordinarily situated out of the enclosed space 19 and normally are housed in an outdoor enclosure.

A thermostat 61 monitors the temperature of air within the space 19 and provides a signal to a controller 62. Whenever the temperature in the space 19 is below a predetermined level, the controller operates the heating system 10 in a novel way to increase its operating efficiency. In accordance with the invention, the controller 62, in response to a signal from the thermostat 61 that there is a demand for heat, causes the engine 12 to start-up and drive the heat pump compressor 11 thereby moving heat from the outdoor coil 21 to the indoor duct coil 16. Thermostatic control switches (not shown) or a signal from the controller 62 causes the blower 58 to operate whenever hot fluid is in either of the coils 16 or 17 so that air within the space 19 is heated by such hot coil or coils. When the thermostat 61 signals the controller 62 that the demand for heat is satisfied, the engine 12 and heat pump 11 are shut off.

Heat in the tank 31, in accordance with an important aspect of the invention, is used to heat the space 19 at appropriate times between periods of operation of the engine 12 and heat pump compressor 11. In a simple effective control strategy, the controller 62 for successive periods of heat demand alternates modes of heat supply between 1) operation of the heat pump 11 and 2) exchange of heat from water in the tank 31 without heat pump operation. In the latter mode, the controller 62 operates the pump 41 to circulate water from the tank 31 to the coil 17. During operation in the first mode, i.e. heat pump operation, heat rejected by the engine 12 can be stored in the tank 31, or simultaneously stored in the tank 31 and exchanged at the duct coil. The last of these options is performed when the controller 62 operates the pump 41. This last option may be the preferred mode during the coldest weather when heat demand is high as the temperature of the air delivered to the space will be maximized.

In a typical residential space of 800 to 3,000 square feet of floor space, the tank 31 can store sufficient heat energy in a 40–50 gallon volume of water in a temperature swing of 160° F. to 120° F., for example, to satisfy a moderate heat load for 15 to 20 minutes. By satisfying a heat demand with operation in the mode where the thermal energy is exclusively supplied from the tank 31, in accordance with the invention, the number of times in an hour or day that the heat pump must be energized is reduced. Consequently, the thermal cycling losses in starting up and shutting down the heat pump 11 are proportionately reduced. As much as a 50% increase in the seasonal coefficient of performance of the heat pump can be expected.

In addition to providing a convenient and economical heat storage means for heat rejected by the heat pump prime mover 12, the water heater 13 is available as a back-up heat source when the burner 32 operates. Additionally, the water heater burner 32 is available to supplement the heating capacity of the heat pump 11 at times of unusually high heat demand or during a defrost mode where the outdoor coil is heated by reverse operation of the heat pump circuit in a known manner or at times of relatively low heat demand where it is not comparatively economical to operate the heat pump 11 due to severe cycling losses. When heat demand in the space 19 is relatively low, for example, 20% or less than a design load, the controller 62 discontinues operation of the engine 12 and heat pump 11 and allows the burner 32 to supply required heat. Still further, the water heater serves its ordinary purpose of providing potable hot water.

The maximum temperature of water stored in the tank is limited to a predetermined value typically at least 160° F. and not more than 200° F. A sensor 76 monitors the temperature of water in the tank 31 and provides a signal indicative of such temperature to the controller 62. The controller 62, when the temperature of potable water in the tank is at the predetermined maximum operates a by-pass valve 83 causing the flow of engine coolant to pass through a line 84 to by-pass the motor 63 and heat exchanger 51. As a result no additional heat is transferred into the potable water stored in the tank 31 through the heat exchanger 51 as long as the temperature of the water in the tank is at or near the predetermined maximum. The thermostatic burner control valve 34 originally supplied with the tank 31 is set to allow preferential use of rejected heat from the engine 12. A diverter valve 81, shunts engine coolant through a heat exchanger 83, cooled by ambient air for example, where the tank 31 has absorbed its full capacity of heat and/or the temperature of the returning coolant in the line 53 exceeds a predetermined value as sensed by an associated thermostatic control element 82 for proper operation of the engine 12.

It should be evident that this disclosure is by way of example and that various changes may be made by adding, modifying or eliminating details without departing from the fair scope of the teaching contained in this disclosure. In the disclosed embodiment, the condition of the engine coolant, as represented by its flow through the line 52, is sensed by the motor 63 which, in turn, is energized to drive the associated pump 64 and circulate potable water from and to the tank 31 for heating. Operation of the pump 64 is thus in response to a condition of flow of the engine coolant. This relationship has advantages over a potable water pump that simply operates coincidentally with operation of the engine. For example, a thermostat can delay engine coolant flow until a desired engine temperature is reached and in such case potable water will not be inefficiently prematurely circulated. It is contemplated that other means for sensing the condition of the engine coolant can be provided to respond to its flow, pressure and/or temperature. Similarly, other methods are contemplated for driving a substitute for the pump 64 such as an electric motor which can be under the control of the engine coolant sensing means. The invention is therefore not limited to particular details of this disclosure except to the extent that the following claims are necessarily so limited.

I claim:

1. A heat storage system comprising an intermittently operating fuel-fired heat engine, a coolant fluid for absorbing the rejected heat of the engine, a path for circulating the coolant fluid between the heat engine where it absorbs heat and a heat transfer zone where it gives up heat, means for forcibly circulating the coolant fluid through its associated path, a storage type potable hot water heater including a tank containing a volume of potable water, a path for circulating potable water between the tank and a heat transfer zone where it absorbs heat given up by the coolant fluid at its respective heat transfer zone, means responsive to the circulation of the coolant fluid to forcibly circulate the potable water through its associated path between the tank and its respective heat transfer zone to produce efficient heat transfer between the heat coolant fluid and the potable water at their respective heat transfer zones.

2. A heat storage system comprising a heat source, a heat conveying fluid for the heat source, a path for circulating the heat conveying fluid between the heat source where it absorbs heat and a heat transfer zone where it gives up heat, means for forcibly circulating the heat conveying fluid through its associated path and thereby imparting hydraulic energy to the fluid, a storage type potable hot water heater including a tank containing a volume of potable water, a path for circulating potable water between the tank and a heat transfer zone where it absorbs heat given up by the heat conveying fluid at its respective heat transfer zone, means for utilizing the hydraulic energy of the heat conveying fluid to forcibly circulate the potable water through its associated path between the tank and its respective heat transfer zone to produce efficient heat transfer between the heat conveying fluid and the potable water at their respective heat transfer zones.

3. A heat storage system as set forth in claim 2, wherein said heat source is a fuel-fired prime mover and including means allowing said heat conveying fluid to serve as a coolant to absorb heat rejected by the prime mover.

4. A heat storage system as set forth in claim 3, including a motor pump unit arranged to be driven by the hydraulic energy of the coolant fluid and to positively pump potable water from the tank through its respective circulating path.

5. A heat storage system for space conditioning comprising a heat pump, a fuel fired prime mover for operating the heat pump, the heat pump including an indoor heat exchanger and an outdoor heat exchanger, a storage type potable hot water heater including a tank, potable hot water indoor heat exchanger means for receiving potable hot water from the tank a potable hot water heat transfer unit external of the tank, a path for circulating potable hot water between the tank and the heat transfer unit, a coolant fluid for absorbing heat rejected by the prime mover, a coolant fluid heat transfer unit, a path for circulating coolant fluid between the prime mover and the coolant fluid heat transfer unit, the potable hot water and coolant fluid heat transfer units being in substantially direct thermal communication, pump means responsive to operation of the prime mover to develop positive flow of the coolant fluid through its circulating path, a motor pump unit operated by the hydraulic energy of the coolant fluid flowing through the circulating coolant fluid path to positively pump water through the circulating potable hot water path between the tank and the potable hot water heat transfer unit, whereby water is automatically circulated between the tank and its associated heat transfer unit by operation of the motor pump unit when the prime mover is operated.

* * * * *